United States Patent [19]

Corey

[11] Patent Number: 4,522,030

[45] Date of Patent: Jun. 11, 1985

[54] MULTI-CYLINDER HOT GAS ENGINE

[75] Inventor: John A. Corey, North Troy, N.Y.

[73] Assignee: Mechanical Technology Incorporated, Latham, N.Y.

[21] Appl. No.: 605,855

[22] Filed: May 1, 1984

[51] Int. Cl.[3] ..... F02G 1/04

[52] U.S. Cl. ..... 60/525; 60/517

[58] Field of Search ..... 60/517, 525, 526

[56] References Cited

U.S. PATENT DOCUMENTS

| | | | |
|---|---|---|---|
| 2,590,662 | 3/1952 | Van Weenen | 60/525 |
| 3,940,934 | 3/1976 | Hakansson | 60/525 |
| 4,261,173 | 4/1981 | Lorant | 60/525 |
| 4,417,443 | 11/1983 | Lorant | 60/525 |
| 4,422,291 | 12/1983 | Berntell | 60/526 X |

*Primary Examiner*—Stephen F. Husar

*Attorney, Agent, or Firm*—Joseph V. Claeys; Arthur N. Trausch III; Charles W. Helzer

[57] ABSTRACT

A multi-cylinder hot gas engine having an equal angle, V-shaped engine block in which two banks of parallel, equal length, equally sized cylinders are formed together with annular regenerator/cooler units surrounding each cylinder, and wherein the pistons are connected to a single crankshaft. The hot gas engine further includes an annular heater head disposed around a central circular combustor volume having a new balanced-flow hot-working-fluid manifold assembly that provides optimum balanced flow of the working fluid through the heater head working fluid passageways which are connected between each of the cylinders and their respective associated annular regenerator units. This balanced flow provides even heater head temperatures and, therefore, maximum average working fluid temperature for best operating efficiency with the use of a single crankshaft V-shaped engine block.

33 Claims, 11 Drawing Figures

#1
#2
#3
#4
5
6
11
12
13
14
15
16
17
18
19
20
22
23
24
25
26
27
27A
27B
28
31
32
36
37
41
42
43
44
45
46
47
48
49
51

11
48
49
51

41
43
44
46

Fig. 4A
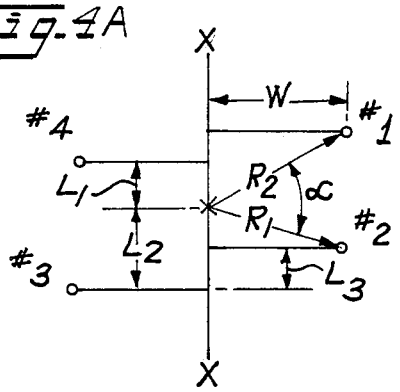
Fig. 4B
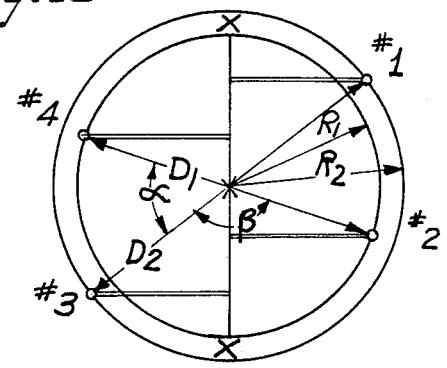
Fig. 4C
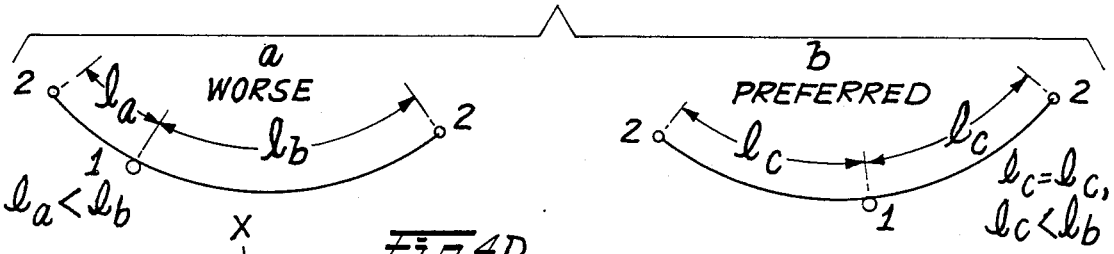
Fig. 4D
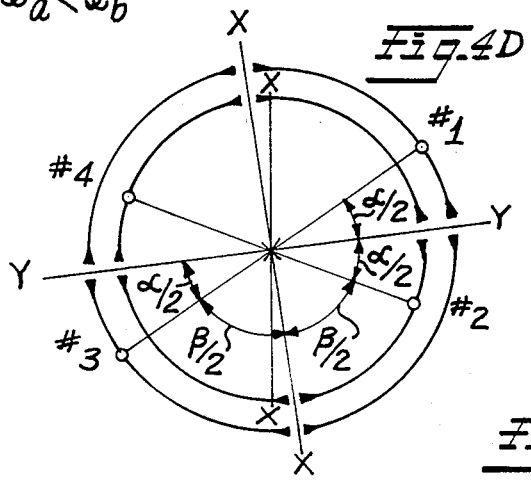
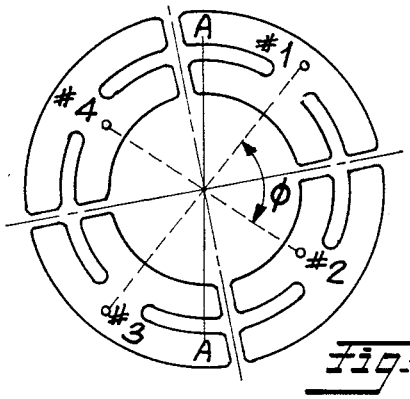
Fig. 4F
Fig. 4E
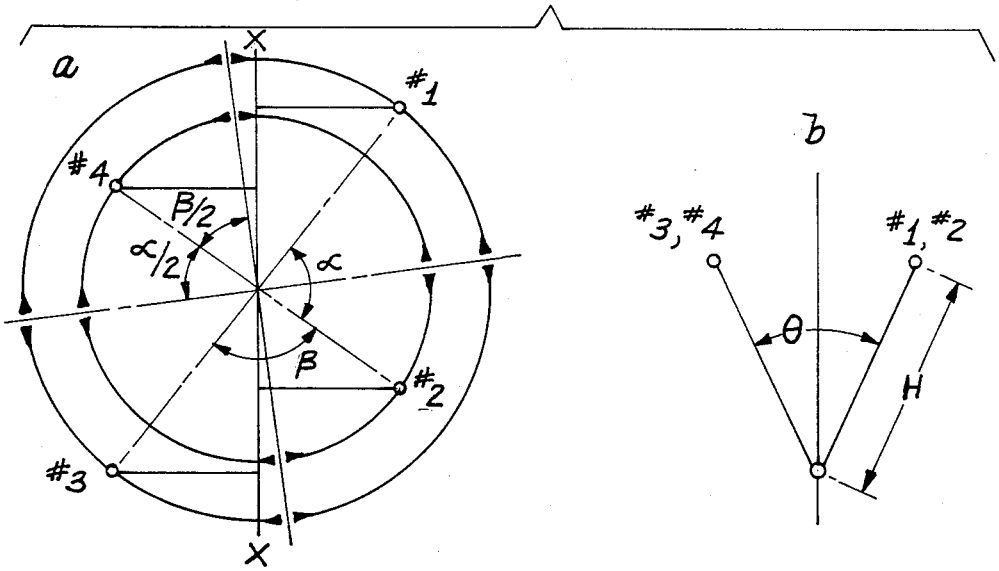

MULTI-CYLINDER HOT GAS ENGINE

The Government of the United States of America has rights in this invention pursuant to Contract DEN3-32 awarded by the U.S. Department of Energy.

TECHNICAL FIELD

This invention relates to hot gas engines of the Stirling engine type and more particularly to a lower cost, high operating efficiency engine of such type having its cylinders in an equal V formation.

More specifically the invention relates to a new and improved multi-cylinder hot gas engine having a V-shaped engine block wherein many of the interconnecting passageways for hot gases are integrally formed in the block and which employs an annular heater around a central circular combustor volume with a novel balanced flow hot gas manifold arrangement that provides balanced flow of working fluid in the heater to assure uniform heater temperature throughout. This uniform temperature allows the maximum possible average temperature which in turn maximizes engine efficiency.

BACKGROUND PRIOR ART

U.S. Pat. No. 4,261,173 issued Apr. 14, 1981, discloses a hot gas engine heater head for a multi-cylinder, double-acting hot gas engine in which each cylinder is surrounded by an annular regenerator unit and in which the top of each cylinder and its surrounding regenerator unit are interconnected by a heater head comprised of a plurality of heater tubes interconnecting the cylinder tops and surrounding regenerator unit tops, the individual heater heads being then arranged to form a single annular heater around a single combustor volume. For this purpose, arcuately-shaped manifolds are provided on the tops of the cylinders and of the annular regenerator units to form two complete concentrically disposed rings of arcuately-shaped manifolds. In U.S. Pat. No. 4,422,291 issued Dec. 27, 1983, a hot gas engine heater head construction for a multi-cylinder double acting hot gas engine is described in which each cylinder is surrounded by an annular regenerator unit and in which the tops of each cylinder and its surrounding regenerator are interconnected by a multiplicity of heater tubes fabricated in the manner disclosed in U.S. Pat. No. 4,261,173. In U.S. Pat. No. 4,422,291, the manifold assembly comprises a centrally disposed duct connected to the top of each cylinder and surrounded by a wider diameter annular-shaped duct connected between the opposite ends of the heater tubes and the regenerator unit. With this configuration, the manufacture of the manifolds and the joining of the heater tubes to the manifolds is simplified and makes it possible to use different materials in the components exposed to thermal stresses with a minimum of problems encountered with the necessary joints. U.S. Pat. No. 3,940,934 issued Mar. 2, 1976, describes a heater head construction for Stirling engines having an essentially V block wherein the cylinders, pistons, piston-rods, wrist pins, and connecting rods to the crankshaft for the cylinders in each bank of the V-shaped block are of the same length and identical construction so as to minimize the number of component parts required in the construction of the engine. An engine possessing these characteristics hereafter is referred to as an equal-V engine as opposed to previously known unequal V engines such as disclosed in FIG. 3 of U.S. Pat. No. 4,261,173 and in U.S. Pat. No. 4,417,443.

However, the multi-cylinder, equal V engine disclosed in U.S. Pat. No. 3,940,934, while it does employ a single annular heater head cannot employ properly balanced arcuately-shaped manifolds and requires a plurality of regenerator canisters which are interspaced between the cylinders of the engine.

The prior art annular heater head in combination with arcuately shaped manifolds was recognized as being desirable. For example, the arcuately shaped manifolds provided for good flow distribution to the heater tubes. Heretofore, however, multi-cylinder, hot gas engines which attempted to combine the desirable annular multi-tube heater head, and the desirable arcuately-shaped manifolds to assist in achieving a balanced flow of working fluid through the heater tubes have not been entirely satisfactory because of the required engine complexity and resulting high production cost. For example, such an arrangement was possible with the multiple crankshaft, square cylinder formation engine shown in FIG. 1 of U.S. Pat. No. 4,261,173, or in the V-type engine requiring only a single crankshaft but only if the cylinders were arranged in an unequal V formation as shown in FIG. 3 of U.S. Pat. No. 4,261,173 and in U.S. Pat. No. 4,417,443.

The present invention for the first time provides a multi-cylinder, hot gas engine which is less expensive to produce than any known prior art configurations and which combines the desirable annular, multi-tube heater head, an annular regenerator, and arcuately shaped manifolds and achieves the desirable maximum average working fluid temperature for best engine operating efficiency, and employs a single crankshaft, equal V cylinder formation. In accordance with this invention, the arcuately-shaped manifolds can be formed in an optimum manner for flow distribution to the attached heater tubes by balancing and minimizing the lengths of the arcuate manifold between the cylinder and regenerator tops and the most distant of the heater tubes on the arcuate manifold. Accordingly, the present invention reduces manufacturing costs because of simpler machining of an equal V cylinder formation as contrasted to an unequal V cylinder formation, uses fewer engine parts, and achieves high engine operating efficiency. In order to reduce manufacturing costs, employ the desirable annular regenerator and annular multi-tube heater head and achieve good flow balance, the present invention was devised.

SUMMARY OF THE INVENTION

It is therefore an object of the invention to provide a new and improved multi-cylinder hot gas engine having an equal angle, V-shaped engine block in which two banks of equal length, equally sized cylinders are formed together with annular-shape cooler/regenerator units surrounding each cylinder, and wherein the interconnecting working fluid passageways are integrally formed within the block. The hot gas engine further includes an annular heater disposed around a central circular combustor volume having a novel, balanced-flow hot-working-fluid, manifold assembly that provides optimum balanced flow of the working fluid through the heater tubes or other hot working fluid passageways which are connected between each of the cylinders and their respective associated annular regenerator units. This balanced flow provides equal heater tube temperatures and, therefore, maximum average working fluid temperature for best operating efficiency.

In practicing the invention, a double-acting, multi-cylinder hot gas engine is provided which comprises a V-shaped engine block formed by two banks of cylinders with the cylinders in each bank having parallel, equal length axes for the piston rods, connecting rods, and pistons reciprocatingly mounted therein. The planes containing the axes of the cylinders in each bank intersect along or near the axis of a single crankshaft. Annular regenerator means are provided and define a regenerator space immediately surrounding each cylinder. A single annular heater head assembly is provided which includes a plurality of annularly arrayed, hot working fluid passageways. A combustor is provided within the central opening of the annular heater head assembly; the hot combustion gases of which flow past the hot working fluid passageways and heat the working fluid therein. A balanced flow manifold arrangement is provided for interconnecting the working fluid passageways in the heater head between the expansion space and the regenerator space of the respective cylinders. The balanced flow manifold assembly comprises two concentric (inner and outer) rings of arcuately-shaped manifold chambers with the number of arcuate manifold chambers in each ring being equal in number to the number of cylinders. Each of the manifold chambers in one of the concentric rings communicates with a respective expansion space of one of the cylinders and each of the respective manifold chambers of the other concentric ring communicates with the respective regenerator space of said one of the cylinders. The plurality of working fluid passageways of the heater head are arranged in a circle around the combustor with each working fluid passageway having one end thereof communicating through a respective manifold chamber to the expansion space of one of the cylinders and the remaining end of the working fluid passageway communicating through a respective manifold chamber to the regenerator space of the same cylinder. To assure balanced heat flow to the working fluid of each cylinder, the number of working fluid passageways thus connected to the respective expansion and regenerator spaces of each cylinder are equal to the number of working fluid passageways respectively connecting to the manifolds of the other cylinders in the multi-cylinder engine and the respective manifold chambers for each cylinder are substantially centered over the axial extension of the axial centerlines passing through the cylinder, or as near thereto as possible.

BRIEF DESCRIPTION OF THE DRAWING

These and other objects, features and many of the attendant advantages of this invention will be appreciated more readily as the same become better understood from a reading of the following detailed description, when considered in connection with the accompanying drawings, wherein like parts in each of the several figures are identified by the same reference characters, and wherein:

FIGS. 4A, 4B, 4C, 4D, 4E and 4F comprise a series of schematic functional diagrams illustrating the design characteristics for the balanced heater head hot gas manifold assembly of FIG. 3 and show how the improved manifold assembly provides for balanced flow of hot working fluid gases through the heater tubes between manifold chambers associated with the expansion spaces and the regenerator spaces of each of the cylinders in the multi-cylinder hot gas engine;

BEST MODE OF PRACTICING THE INVENTION

Figure 1:
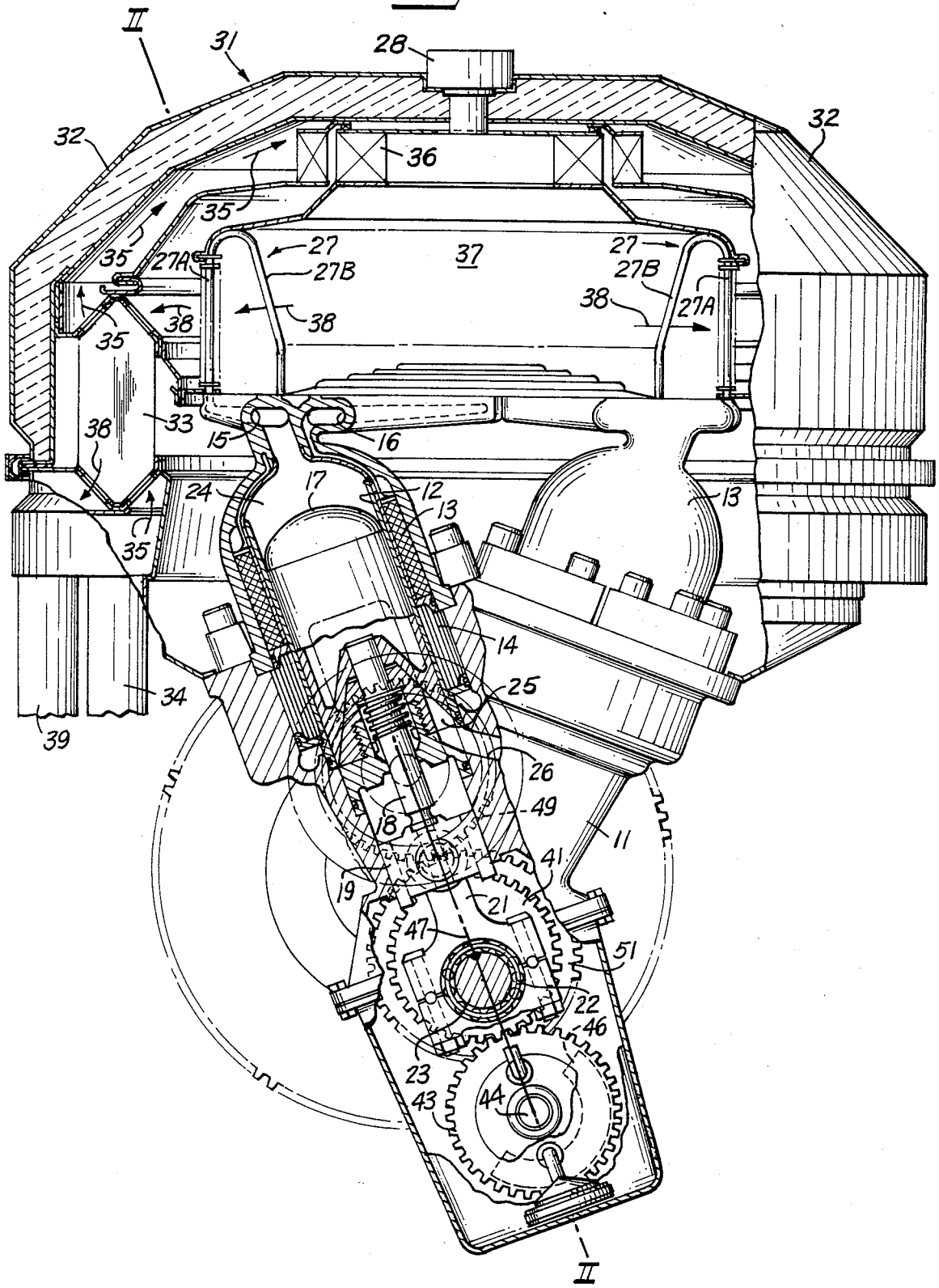
FIG. 1 is a vertical cross sectional view of a multi-cylinder hot gas engine constructed according to the invention and shows the essentially equal V-shaped character of the engine block comprising a part of the engine.
Figure 2:
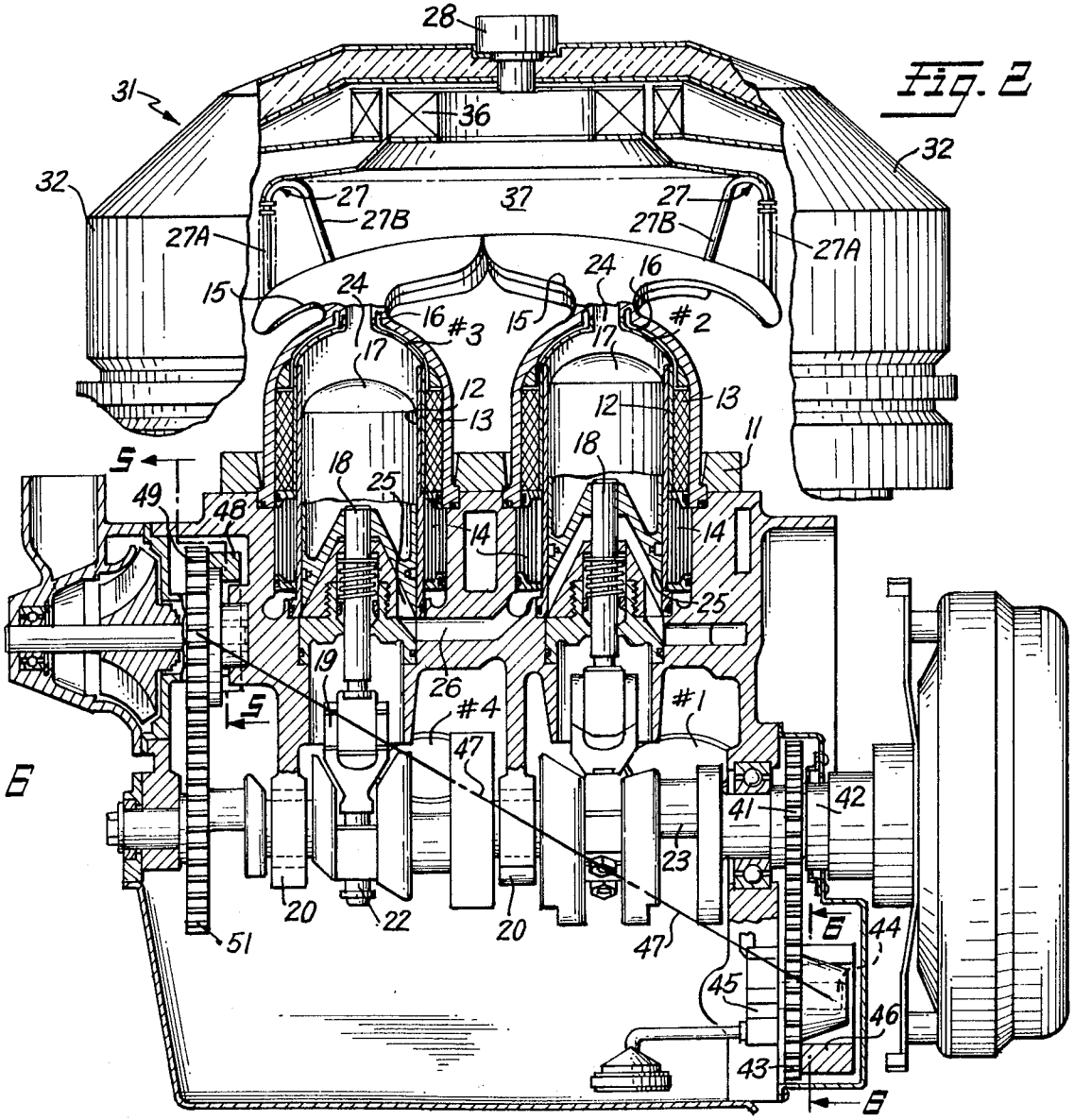
FIG. 2 is a longitudinal sectional view of the multi-cylinder hot gas engine taken essentially along the plane II—II of FIG. 1.
Figure 5:
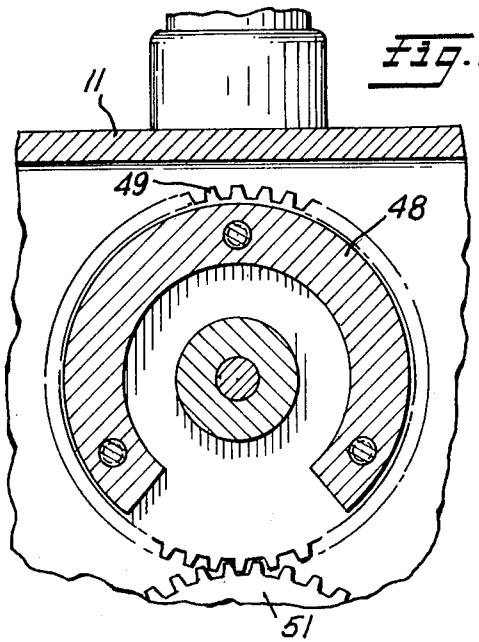
FIG. 5 is a partial cross-sectional view of the engine taken across lines 5—5 of FIG. 2.
Figure 6:
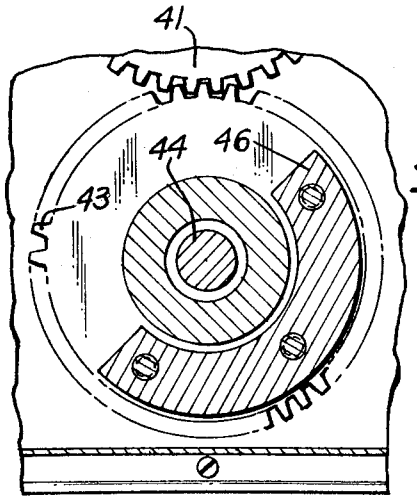
FIG. 6 is a partial cross-sectional view taken across lines 6—6 of FIG. 2.
Figure 3:
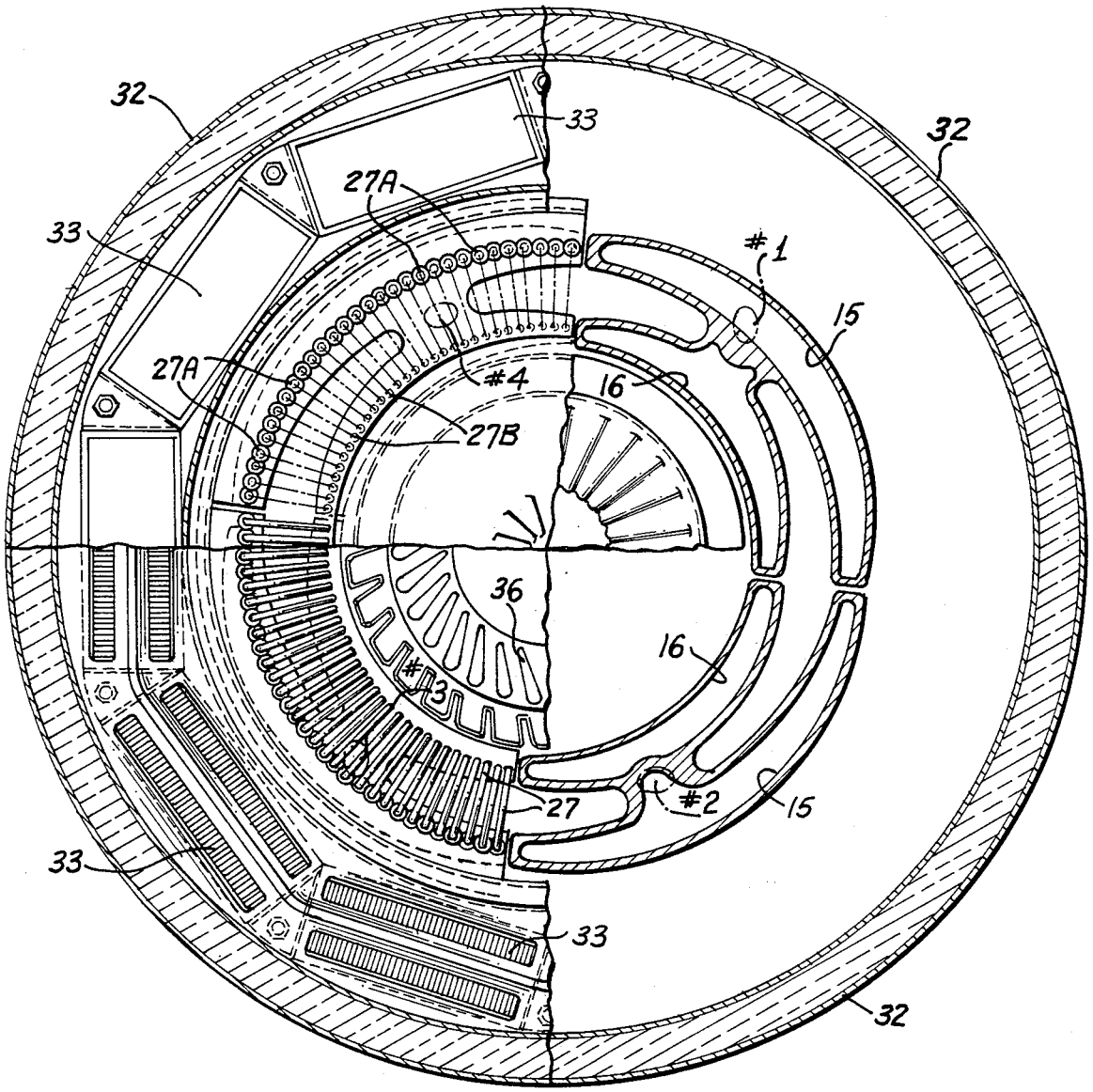
FIG. 3 is a partially broken away, top planar view of the heater head assembly used on the engine shown in FIGS. 1 and 2 with the various arcuate quarter segments of the annular-shaped heater head assembly being taken along different horizontal section levels.

In FIGS. 1 and 2 of the drawings there is shown a multi-cylinder, double acting hot gas engine having an equal-V engine block having a single crankshaft, and a single, annular heater head assembly constructed according to the invention. The engine includes a generally V-shaped block portion 11 in which there are formed four cylinders indicated at 12 with each cylinder being surrounded by a respective annular regenerator unit 13 and its serially connected annular cooler unit 14. The four cylinders 12 are provided with individual arcuate-shaped expansion space manifolds 15 and arcuate regenerator manifolds 16 which (as best seen in FIG. 3 of the drawings) form respective outer and inner concentric rings of manifold chambers. Manifolds 15 and 16 extend over the tops of all four cylinders. As will be explained more fully hereafter with relation to FIGS. 4A through 4E of the drawings, the arrangement is such that the axial centers of the cylinders if extended up through the plane of the concentric inner and outer manifolds 15 and 16 would intersect the plane of the manifolds at points which are the corners of a parallelogram.

Each cylinder 12 of the double-acting hot gas engine has a piston 17 reciprocatingly mounted therein. Piston 17 is connected by a piston rod 18 to a crosshead 19. Crosshead 19 moves reciprocally up and down within a cylinder formed under the cylinder 12 in block 11 and is connected through a connecting rod 21 to a bearing 22 surrounding and driving a crank arm comprising a part of the single crankshaft 23 of the engine. Crankshaft 23 is supported by main bearings 20 as best seen in FIG. 2 of the drawings. For a more detailed description of the construction of the piston 17, piston rod 18, crosshead 19, connecting rod 21 and its connection to bearing 22, reference is made to copending U.S. application Ser. No. 605,782, entitled "Light Weight Piston-Rod Assembly for a Reciprocating Machine" by John Corey and Michael M. Walsh, inventors, filed concurrently with this application, and which is assigned to the same assignee as this invention.

The pistons 17 separate each cylinder 12 into a high temperature expansion space shown generally at 24 on top of the piston, and a low temperature compression space 25 below the piston. Expansion space 24 communicates with the expansion space manifold 15 described briefly above. The low temperature compression space 25 communicates through a cool working fluid passageway 26 communicating with the annular cooler unit 14 and regenerator unit 13 around the next adjacent cylinder in a known manner for double-acting hot gas engines.

The respective pairs of expansion manifolds 15 and adjacent regenerator manifolds 16 located over each cylinder are interconnected by a plurality of annularly-arrayed, hot working fluid passageways, shown in the drawings as formed by a plurality of annularly-arrayed heater tubes 27. Heater tubes 27 are bent generally in the form of an inverted U with the end 27A of one of the arms of the U being connected to the expansion space manifold 15 and with the other end of the tube 27B being connected to the regenerator manifold 16. Each of the heater tubes 27 is shown as being provided with a plurality of fins secured around the periphery thereof to provide greater heat exchange capacity. As best seen in FIG. 3 of the drawings, the number of inverted U-shaped heater tubes 27 which thus interconnect the respective sets of expansion manifolds 15 and their associated regenerator manifolds 16 positioned over each cylinder 12 is equal for all cylinder sets so as to provide for a balanced flow of heated working fluid through the heater tubes 27 to and between the high temperature expansion space 24 and the regenerator space 13 of every cylinder.

During operation the multi-cylinder, hot gas engine shown in FIGS. 1 through 3 functions as a double-acting engine wherein heat is supplied continuously to the engine from a combustor that includes a fuel nozzle 28 disposed in the center of the annularly-arrayed heater tubes 27. The working fluid, which generally is a gas such as hydrogen or helium, is continuously circulated in each of four completely closed systems which are composed of an expansion space 24, the interior of expansion manifold 15, interior of the heating tubes 27, the interior of regenerator manifold 16, through the regenerator 13, the cooler 14, and the cooling passageway 26 over to a corresponding low temperature compression space 25 of the next adjacent cylinder. During a complete up and down cycle of the pistons in the cylinders from lower-most position to upper-most position back to lower-most position, the working gas in each closed system will sequentially pass through the stages of compression, cooling, regeneration, heating, and expansion back through the stages of heating, regeneration, cooling, and compression thereby completing one cycle of operation of the four cycle engine. For a more complete description of the operation of a 4 cycle hot gas engine, reference is made to an article appearing in Mechanical Engineering Magazine—May, 1983 issue, pages 26 through 27.

Because the efficiency of operation of the engine depends directly on the ratio between average expansion temperature (which temperature is limited by the material properties of the heater tubes 27) and average compression temperature, it is desirable that evenly balanced flow of the working fluid occur in all of the heater gubes 27 such that those tubes being equally heated by the circular combustor are evenly cooled by the evenly balanced flow of the working fluid therein. In this way, the temperatures of the heater tubes 27 are maintaioned at a substantially equal temperature which is kept near the maximum allowable temperature of the material in order to maximize the average expansion temperature. For this purpose, the inner concentric ring of regenerator manifold chambers 15 and the outer ring of expansion manifold chambers 16 are divided into sectors of equal arcuate length, the number of which sectors being equal to the number of cylinders in the engine, typically four. Each of these equal arcuate sectors is assigned to and occupied by the manifold chambers and associated heater tubes 27 of a respective cylinder. By this arrangement each cylinder has associated with it an equal number of equally spaced heater tubes which occupy an equal fraction of the heater head circle, so that each cycle of working fluid (associated with each respective cylinder) is exposed equally to the hot gases of the combustor whereby each cycle can receive equal heat in accordance with the equal flows of working fluid casued by equal-sized pistons, cylinders, etc. in each cycle. This assures that no cycle will have a substantially different average heater temperature from any other cycle. However, to assure that for each cycle the temperature in all of its associated heater tubes is substantially equal, the manifold chambers must be arranged to assure that equal flow from the respective cycle is distributed evenly to each such associated heater tube thereby assuring that tube temperature within each sector is substantially equal. To this end, manifold chambers 15 and 16 are arranged such that the centers of the arcs of their respective arcuate manifold chambers are disposed at, or as close thereto as possible, to the intersection of the axial extensions of the center axis of each of the respective cylinders 12 in the V-shaped block with the plane of the concentric rings of inner and outer manifold chambers 15 and 16. By design, these points define the corners of a parallelogram at the point of intersection of the axial extensions of the axes of the cylinders with the plane of the concentric rings of manifold chambers 15 and 16 and by specific arrangement of the geometry of such parallelogram the centering of the manifold arcs described above is achieved with minimal additional passage volumes between cylinders and manifolds and with such additional volumes as are required being substantially equal for all cycles. This arrangement is obtained in the following described manner.

Given a four cylinder, equal angle V engine block (i.e. an engine block having two banks of cylinders with parallel equal length axes in each bank), a schematic view from above the cylinders and crankshaft axis would appear as shown in FIG. 4A. In FIG. 4A, line X-X-X represents the crankshaft axis with the X's being the main bearings. The dots in this figure labelled 1, 2, 3 and 4 represent the tops of the cylinders and the lines from the crankshaft axis X-X-X to each of the dots numbered 1, 2, 3 and 4 represents the length of the cylinder axes as numbered. Note that $L_2$ is the distance from the center bearing to either the number 1 or number 3 cylinder axis measured parallel to the crankshaft axis and that $L_1$ is the distance from the center bearing to the cylinder axes of the number 2 or number 4 cylinders. The lateral offset of each cylinder top from the crankshaft axis X-X-X is the projection of the cylinder axis onto this viewing plane. This offset is measured by W. The dimensions of $R_2$ and $R_1$, respectively, measure the distance in this plane from the center bearing, which is the overall center of the cylinder arrangement on the crankshaft to the tops of the cylinders number 1 or number 3, and number 2 or number 4, respectively. The angle $\alpha$ is the angle defined between $R_1$ and $R_2$ again measured in the viewing plane.

In order to employ a single annular heater head and circular combustion space centered therein, as well as having the annular heater head centered over all the cylinders of the egine, the two concentric outer and inner manifold rings 15 and 16 (described with relation to FIGS. 1 through 3) are designed such that their radii $R_1$ and $R_2$, respectively, define circles which pass through the intersection points #1, #2, #3, and #4 as shown in FIG. 4B. As shown in FIG. 4B, the circles which connect the tops of the respective cylinders #2, #4 and #1 and #3 have diameters $D_1$ and $D_2$, respectively, and correspond to the diameters of the inner and outer concentric rings of manifolds 16 and 15.

The angles subtended by the diameters $D_1$ and $D_2$ are respectively $\alpha$ and $\beta$ where $\beta$ equals 180° minus $\alpha$. It will be seen in FIG. 4B that the manifold circles necessarily are divided into four quadrants with each quadrant serving one cylinder. In order to assure a balanced flow of heat to each and every cylinder, the quandrants should each occupy one-quater ($\frac{1}{4}$) of the entire manifold circle. Further, the arrangement should be such that the quadrants, as much as possible are centered over the respective cylinder tops in order to equalize and minimize the length of the manifold arcs extending from the cylinder top to the quadrant ends as shown in FIG. 4C (a) and (b).

In order to provide evenly balanced arc lengths for the respective manifold chambers 15 and 16 as defined above, the quadrants subtended by the manifold chambers 15 and 16, as illustrated in FIG. 4B and FIG. 3, are defined by bisecting the respective angles $\alpha$ and $\beta$ as shown in FIG. 4D. Each quadrant X-Y or Y-X is substantially 90° long and consists of two sides of arc lengths $\alpha/2$ and $\beta/2$, respectively, measured from the respective cylinder tops to the quadrant ends in which such cylinder tops are substantially centered. It should be noted that rotation of the X-X, Y-Y division pattern in either direction from the $\alpha$, $\beta$ bisections will improve two of the quadrants by reducing the longer manifold arc lengths as the cost of increasing the longer arc lengths of the opposite manifold sets. For example, clockwise rotation in FIG. 4D would improve the #2 and #4 cylinder manifolds by equalizing the arc lengths from cylinder top to associated manifold arc ends, but if the 90° quandrant divisions are to be maintained, then the other two quadrants containing the #1 and #3 cylinders for clockwise rotation would be made more unbalanced in arc length from cylinder to associated manifold arc ends. It will be appreciated therefore that the best way to achieve substantially equal lengths of manifold arc on all four 90° quadrants is to set $\alpha/2$ equal to $\beta/2$ and therefore both $\alpha$ and $\beta$ equal 90°. Referring back to FIG. 4A, it will be seen that for $\alpha$ equal 90°:

$$(L_1+L_2)^2=R_1^2+R_2^2 \quad (1)$$

$$R_2=W^2+L_1^2 \quad (2)$$

$$R_2^2=W^2+L_2^2 \quad (3)$$

The above three equations in five unknowns can be readily solved for a given engine in the following manner. For a given cylinder height H and angle $\theta$ between banks of cylinders, the dimension W is fixed. This then fixes the dimensions $R_1$ and $R_2$ and $L_1$ and $L_2$. As shown in FIG. 4A $L_3$ also is prescribed via the relationship $$(L_1+L_3)^2+W^2=R_2^2 \quad (4)$$

The dimensions H, $\theta$, $L_3$ all are determined from rthe diametral size and crankshaft bearing space requirements for the individual cylinders in a minimum-packing-space designed engine. Note that solution of these equations does not place the cylinder tops in a square formation but instead places the tops in a prallelogram array at the points where the axial extensions of the cylinder centerlines intersect the plane of the outer and inner concentric manifold rings 15 and 16. It will be appreciated therefore that by the means described above, the invention can be practiced by specifically shaping the connections between the cylinder tops and the manifold chamber arcuate lengths in an advantageous manner such that the quadrants are formed by two manifold arcs substantially equal in length which together contain 90° of arc length or as close thereto as possible. The result is to provide an annular-shaped, cylinder top heater head assembly which, being associated with a non-square arrangement of cylinder tops, adapted to fit over a single crankshaft, equal angle V-shape block engine still can be readily formed into an evenly-divided circular heater head to assure balanced flow of working fluid and thereby even temperature and maximum efficiency. This arrangement is illustrated schematically in FIG. 4E of the drawings and more graphically in FIG. 4F.

If other engine design requirements prevent construction of the heater head assembly of the multi-cylinder hot gas engine in the above-described manner, it is still possible to obtain a substantially balanced flow of working fluid through the heater tubes 27, so long as the deviation from the above-described equal-arc manifold arrangement is not excessive. This can be accomplished by properly shaping the cross-sections of the arcuately-shaped manifolds so as to assure a substantially equal pressure drop ($\Delta p$) across all flow paths between the regenerator and expansion space (all of which pass through the manifolds and heater tubes). This can be done by tapering the ends of the arcuate lengths or otherwise constricting the cross-sectional area of the ends of the arcuate lengths so as to achieve the desired result.

Referring back to FIGS. 1 and 3 of the drawings, the heater head assembly for the engine, shown generally at 31 is further comprised by a circular insulating cover 32 which surrounds the annular array of heater tubes 27. Disposed between the outer skirt of the insulating cover 32 and the annular array of heater tubes 27 is annular preheater assembly 33 the construction and operation of which is described more fully in copending U.S. Patent application Ser. No. 605,785 entitled, "Heat Exchanger with Ceramic Elements" John A. Corey inventor, filed concurrently with this invention, assigned to the same assignee, and the disclosure of which is hereby incorporated into this application in its entirety.

For a detailed description of the annular preheater assembly 33 reference is made to the above copending application (U.S. Ser. No. 605,785). Briefly, however, cool incoming combustion air is drawn through an intake duct 34 and travels through the preheater assembly 33 in the direction shown by the arrows 35 where it is preheated from heat extracted from a counter-flow of exhausted combustion gases passed through the counter-flow heat exchanger of preheater assembly 33. The preheated combustion air 35 then flows through a set of turbulator vanes 36 which introduce the preheated combustion air in a swirling vortex manner into the space around the fuel nozzle 28 and into the combustor area 37. The hot combustion gases produced by this combustion process swirl through the central combustion chamber area 37 and pass out between the heater tubes 27 as shown by the arrows 38 where it first heats the working fluid passing through heater tubes 27. The hot combustion gases then are exhausted out through the counter-flow heat exchanger of preheater assembly 33 and out through suitable exhaust ducting 39.

Referring now to FIG. 2 of the drawings, the single crankshaft 23 of the engine is best shown supported for rotation in the equal V engine block by main bearings 20. In accordance with the usual practice to reduce vibration in reciprocating piston machines the crankshaft 23 is provided with suitable counterbalance weights. While this is a substantial improvement as compared to a non-counterbalance crankshaft, there still remain relatively large residual imbalance forces and moments which rotate about the cylinder axis in a direction opposite the crankshaft rotation and which result in substantial vibration during operation.

In order to further reduce such vibration-producing forces the equal V, double-acting mutli-cylinder hot gas engine of this invention is provided with a balancing means comprising two counterbalance weights disposed toward opposite ends of the crankshaft from the center of action of the residual imbalance force and which weights rotate at the same speed as the crankshaft but in a direction opposite to that of the crankshaft. These counter-rotating counterbalance weights are arranged to be driven from the crankshaft and disposed at selected distances on opposite sides of the axis of rotation of the crankshaft to create a single virtual balance axis which ideally intersects the crankshaft axis (i.e. the imbalance axis) at the center of action of the resolved imbalance forces and moments.

In order to create this single virtual balance axis identified as the axis 47 in FIG. 2, an appropriate eccentric weight 46 is driven from one end of crankshaft 23 through the gears 41 and 43. The gear 41 is secured to crankshaft 23 and meshes with the gear 43 to which is secured the eccentric weight 46. Eccentric weight 46 may be a separate member or it may be provided by a suitable eccentrically weighted working member of an auxiliary device such as an oil pump. Also, a similar eccentric weight 48 is driven from the opposite end of crankshaft 23 through gears 49 and 51. The gear 51 is secured to crankshaft 23 and meshes with the gear 49 to which is secured the eccentric weight 48. Eccentric weight 48 may also be provided by the working member of an auxiliary device such as, for example, a water pump. With the foregoing described arrangement the eccentric weights 46 and 48 are rotating at the same speed as that of the crankshaft but in a direction opposite to the direction of crankshaft rotation. Also, eccentric weight 46 is displaced laterally a selected distance to one side of the axis of rotation of crankshaft 23 and the eccentric weight 48 is displaced laterally a similar distance substantially on the opposite side of the axis of rotation of the crankshaft 23.

Also, to minimize the residual moment in the multi-cylinder reciprocating machine, the eccentric weight 46 is disposed a distance D from one end of the crankshaft from the center of action of the imbalance forces in the engine (which point may be, for example, the center of the crankshaft) and the eccentric weight 48 is disposed a similar distance D toward the opposite end of the crankshaft from such center of action in accordance with the following relationship:

$$D=(M_{R-}/F_{B-})\cos\alpha \qquad (5)$$

WHERE, $M_{R-}$ equals the counter rotating component of the reciprocating imbalance moment;

$F_{B-}$ equals the counter rotating balance force which balances the counter rotating component of the reciprocating imbalance force;

$\alpha$ equals the angle subtended between $F_{R-}$ and $F_{MR-}$; and $F_{MR-}$ equals the force components of moment $M_{R-}$ taken as a couple at distances D, −D along the crankshaft.

With the foregoing described arrangement there is created a single balance axis which ideally intersects the crankshaft axis at the center of action of the resolved imbalance forces which, without requiring any additional balancing shafts, balances the forces and minimizes the residual moment. That is, a virtual balancing axis is created which can be drawn between the centers of rotation of the eccentric weight 46 and the eccentric weight 48. As shown in this idealized representation the virtual balance axis 47 intersects the crankshaft axis. In certain situations the virtual balance axis may not actually intersect the crankshaft axis but the arrangement of the eccentric weight 46 and 48 and the amount of lateral displacement thereof from axis of rotation of the crankshaft 23 should be such that it comes as close as practicable to an actual intersection. A deviation from a true intersecting situation will result in less than ideal reduction in vibration but still provides a substantial improvement. Thus, the arrangement should be designed to provide for intersection of the virtual balance axis and the crankshaft axis or as close thereto as possible.

For a more complete description of the construction and operation of the balancing arrangement, reference is made to copending U.S. application Ser. No. 605,854 —"Means and Method of Balancing Multi-Cylinder Reciprocating Piston Machines"—John A. Corey and Michael M. Walsh, Inventors, filed concurrently with this application and assigned to Mechanical Technology Incorporated, the same assignee as this invention, and the disclosure of which is hereby incorporated into this application in its entirety.

As noted above, for a more complete description of the manner of construction and operation of the balancing arrangement, reference is made to the above-noted copending U.S. patent application Ser. No. 605,854. Briefly, however, it can be stated that the virtual balancing axis 47 can be created by using auxiliary gear wheel arrangements driven from the crankshaft 23 whose residual imbalance forces are to be further balanced and the residual moments minimized without requiring the use of one or more additional separate balancing shafts as is often done in the art of reciprocating piston machines.

Most reciprocating machines and certainly those wherein the machines constitute primary power source engines such as the hot gas engine which is the subject of this invention, require auxiliary equipment in the form of water pumps, oil pumps, and the like. In the engine shown, the auxiliary gear wheel 43 in addition to supporting eccentric weight 46 can be used to drive the working member of an auxiliary device, such as an oil pump 45. At the opposite end of the crankshaft the gear wheel 49 driven by gear wheel 51 secured to crankshaft 23 and to which the eccentric weight 48 is secured, can be employed to drive the working member of another auxiliary device, such as the impeller of a water pump shown generally at 52. Alternatively, in accordance with the teachings of the foregoing referenced application U.S. Ser. No. 605,854 the eccentric weights may be carried by the working members of the respective auxiliary devices 45 and 52. Also, if convenient or desirable the working members themselves may be formed to also provide the desired eccentric weights 46 and 48. Thus, by using the foregoing described arrangement to create a virtual balance axis 47 all primary imbalance reciprocating forces can be cancelled out from rotating crankshaft 23 and the residual moment minimized without requiring any additional parts other than those normally employed in a complete hot gas engine operating system.

By reason of the inclusion of the above described features in a multi-cylinder, equal V block, single crankshaft, hot gas engine, as shown in FIG. 1, a low silhouette, compact, relatively lightweight and efficient engine can be constructed which has a minimal number of different parts to thereby reduce the inventory of parts required to construct the engine. This in turn greatly reduces the build-up in tolerances (or errors) in individual part dimensions in an assembly, that can occur in engine designs requiring a large number of different sized parts and components. These features are further enhanced by the provision of an equal angle V-shaped engine block having a single crankshaft, two banks of equal length and sized cylinders with annular-shaped cooler/regenerator units surrounding each cylinder and wherein many of the interconnecting fluid gas passageways are integrally formed in the V-shaped block. As a consequence of the inclusion of all of these characteristic features in a hot gas engine having a single, round annular heater head assembly which provides for optimum balanced flow of heated working fluid to and between the expansion space and the regenerator space of each cylinder, improved construction and operation of the engine as well as reducing its cost, complexity and maintenance is achieved.

Having described one embodiment of a multi-cylinder hot gas engine having unified V block with round combustor and balanced flow of hot gases through heater head assembly manifolds and constructed in accordance with the invention, it is believed obvious that other modifications and variations of the invention will be suggested to those skilled in the art in light of the above teachings. It is therefore to be understood that changes may be made in the particular embodiment of the invention described which are within the full and intended scope of the invention as defined by the appended claims.

Wherein I claim:

1. In a multi-cylinder hot gas engine the combination comprising:

(a) equal V-shaped engine block having two banks of cylinders wherein the cylinders in each bank have parallel equal length axial centerlines and the planes containing such centerlines intersect along or near the axis of a single crankshaft mounted for rotation in said engine block;

(b) a piston in each cylinder connected with the crankshaft for reciprocation in said cylinder, each cylinder having an expansion space above the piston and a compression space below the piston;

(c) an annular regenerator means disposed around each cylinder;

(d) annular heater head means including a plurality of working fluid passageways disposed above the cylinders for supplying heated working fluid to the expansion spaces of all of the cylinders;

(e) combustor means centrally disposed in said annular heater head means for heating the working fluid in said plurality of working fluid passageways;

(f) a plurality of arcuate, balanced-flow manifold means one for each cylinder, each manifold means having a first arcuate portion in fluid communication with the expansion space of the cylinder and with one end of a number of working fluid passageways and having a second arcuate portion in communication with the annular regenerator means of the same cylinder and with the other end of said number of working fluid passageways and wherein the working fluid passageways thus intercommunicating within each of the plurality of arcuate manifold means are equal in number for each cylinder.

2. The multi-cylinder hot gas engine combination according to claim 1, wherein the respective arcuate portions of each manifold means is appropriately proportioned and shaped along the elongated arcuate axis thereof to provide substantially equal pressure drops in the working fluid across all of the working fluid paths interconnecting between the expansion space and regenerator space of each cylinder, and wherein the pressure drops in working fluid across all such fluid paths in the annular heater head means are substantially equal.

3. A multi-cylinder hot gas engine combination according to claim 2, further including annular cooler means disposed around each cylinder immediately under the annular regenerator means thereof.

4. In a multi-cylinder hot gas engine combination according to claim 3, wherein the cylinders in each V-shaped engine block are arranged in multiples of four with the cooler of one cylinder being interconnected through a working fluid passageway to a compression space of the next adjacent cylinder.

5. A multi-cylinder hot gas engine combination according to claim 3, further including an annular preheater circumferentially surrounding the annular heater head means and combustor for supplying preheated combustion air to the combustor and withdrawing hot combustion gases which have been passed through said plurality of working fluid passageways and extracting residual heat in the hot combustion gases for preheating the intake air being supplyed to the combustor.

6. A multi-cylinder hot gas engine combination according to claim 5, wherein the first arcuate portion of the plurality of arcuate, balanced-flow manifold means form an outer concentric ring of manifolds communicating with the expansion spaces of the respective cylinders and the second arcuate portions form an inner concentric ring of manifolds communicating with the annular regenerator means of the respective cylinders and the intersections of the plane of the inner and outer manifold ring with the axial extensions of the cylinder axes define the points of a parallelogram.

7. In a multi-cylinder hot gas engine combination according to claim 6, wherein the cylinders in each V-shaped engine block are arranged in multiples of four with the cooler of one cylinder being interconnected through a working fluid passageway to compression space of the next adjacent cylinder.

8. In a double-acting, multi-cylinder hot gas engine, the improvement comprising a V-shaped engine block formed by two banks of cylinders with the cylinders in each bank having parallel, equal-length axes for connecting rods to pistons reciprocatingly movable therein and with the planes of the two banks containing the axes of the cylinders intersecting along or near the axis of a single crankshaft; annular regenerator means surrounding each cylinder and defining a regenerator space; a single annular heater head means including a plurality of annularly arrayed working fluid passageways; a combustor supported within said annular heater head means for flowing hot combustion gases past the working fluid passageways for heating the working fluid therein; balanced-flow manifold means for interconnecting the working fluid passageways in said heater head means between the expansion space the regenerator space of the respective cylinders, said manifold means comprising two concentric inner and outer rings of arcuately-shaped manifold chambers with the number of arcuate manifold chambers in each ring being equal to the number of cylinders, the respective manifold chambers in one of the concentric rings communicating with a respective expansion space of one of the cylinders, and the respective manifold chambers of the other concentric ring communicating with a respective regenerator space of each cylinder; the plurality of annularly arrayed working fluid passageways being arranged in a circle around the combustor with each working fluid passageway having one end thereof communicating thru a respective manifold chamber to the expansion space of one of the cylinders and the remaining end thereof communicating thru respective manifold chamber to the regenerator space of the same cylinder; and the number of working fluid passageways thus connected to the respective expansion and regenerator spaces of each cylinder being equal to the number of working fluid passageways respectively connected to the other cylinders in the multi-cylinder engine.

9. The multi-cylinder hot gas engine combination according to claim 8, wherein the respective arcuate portions of each manifold means are appropriately proportioned and shaped along the elongated arcuate axis thereof to provide substantially equal pressure drops in the working fluid across all of the working fluid paths interconnecting between the expansion space and regenerator space associated with each cylinder, and wherein the pressure drops in working fluid across all of the fluid paths in the annular heater head means are substantially equal.

10. A multi-cylinder hot gas engine combination according to claim 9, further including annular cooler means disposed around each cylinder immediately under the annular regenerator means thereof.

11. In a multi-cylinder hot gas engine combination according to claim 10, wherein the cylinders in each V-shaped engine block are arranged in multiples of four with the cooler of one cylinder being interconnected through a working fluid passageway to a compression space of the next adjacent cylinder.

12. A multi-cylinder hot gas engine combination according to claim 10, further including an annular preheater circumferentially surrounding the annular heater head means and combustor for supplying preheated combustion air to the combustor and withdrawing hot combustion gases which have been passed through said plurality of working fluid passageways and extracting residual heat in the hot combustion gases for preheating the intake air being supplied to the combustor.

13. A multi-cylinder hot gas engine combination according to claim 12, wherein the first arcuate portion of the plurality of arcuate, balanced-flow manifold means form an outer concentric ring of manifolds communicating with the expansion spaces of the respective cylinders and the second arcuate portions form an inner concentric ring of manifolds communicating with the annular regenerator means of the respective cylinders.

14. In a multi-cylinder hot gas engine combination according to claim 13, wherein the cylinders in each V-shaped engine block are arranged in multiples of four with the cooler of one cylinder being interconnected through a working fluid passageway to a compression space of the next adjacent cylinder.

15. A multi-cylinder hot gas engine comprising in combination a plurality of cylinders disposed along paths forming two banks of cylinders having equal parallel axes and the planes of which form a V-shaped engine block extending from a single crankshaft, each cylinder containing a piston connected to said crankshaft in proper phase relation and dividing said cylinder into a high temperature space and a low temperature space with the low temperature space being nearer said single crankshaft; a plurality of annular regenerator-coolers each communicating between two cylinders and each disposed around a single cylinder; a plurality of working fluid passageways connecting said low temperature space of one cylinder to the cooler of the regenerator-cooler of an adjacent cylinder; a plurality of arcuately-shaped expansion space manifolds each positioned over the axial centerline of a respective cylinder or as near thereto as possible and communicating with the high temperature space of said cylinder; a plurality of arcuately-shaped regenerator manifolds one each positioned over the centerline of each of the cylinders or as near thereto as possible and communicating with the regenerator of the said cylinder; heater head means comprising a plurality of working fluid passageways disposed in a substantially uniform circular array above said cylinders and near the high temperature spaces thereof to define on top of the V-shaped engine blocks a combustion space; said working fluid passageways connecting said expansion space manifold of each cylinder to the associated regenerator manifold of the same cylinder; and a combustor unit mounted in said combustion space for uniformly heating the working fluid in all of the working fluid passageways of said heater head means.

16. The multi-cylinder hot gas engine according to claim 15, wherein the respective arcuate portions of each manifold means is appropriately proportioned and shaped along the elongated arcuate axis thereof to provide substantially equal pressure drops in the working fluid across all of the working fluid paths interconnected between the expansion space and the regenerator space provided for each cylinder, and wherein the pressure drops in working fluids across all of the fluid paths in the annular heater head means are substantially equal.

17. A multi-cylinder hot gas engine according to claim 16, wherein the arcuately-shaped expansion space manifolds are arranged in a first circular array within said heater head means and the arcuately-shaped regenerator manifolds form a second circular array within said heater head means concentrically arranged with respect to said first circular array.

18. A multi-cylinder hot gas engine according to claim 17, wherein the first circular array of arcuately-shaped expansion manifolds form the outer one of the concentric first and second circular arrays and wherein the axial extensions of the center axes of the cylinders intersect the planes of the concentrically-arrayed arcuately-shaped manifolds at points which define the corners of a parallelogram with two of the diagonally opposite points of the parallelogram substantially centered on two oppositely disposed manifolds within the outer first circular array of arcuately-shaped expansion manifolds and the remaining two diagonally opposite points substantially centered on the two oppositely disposed manifolds within the inner second circular array of arcuately-shaped regenerator manifolds.

19. A multi-cylinder hot gas engine according to claim 15, further including an annular preheater circumferentially surrounding the annular heater head means and combustor for supplying preheated combustion air to the combustor and withdrawing hot combustion gases which have been passed through said plurality of working fluid passageways and extracting residual heat in the hot combustion gases for preheating the intake combustion air being supplied to the combustor.

20. A multi-cylinder hot gas engine according to claim 18, further including an annular preheater circumferentially surrounding the annular heater head means and combustor for supplying preheated combustion air to the combustor and withdrawing hot combustion gases which have been passed through said plurality of working fluid passageways and extracting residual heat in the hot combustion gases for preheating the intake combustion air being supplied to the combustor.

21. A multi-cylinder hot gas engine according to claim 15, further including a virtual balancing axis means formed to intersect the crankshaft at or near the center of action of any force imbalance acting on the crankshaft and being proportioned to eliminate any such force imbalance while simultaneously minimizing any residual turning moment, said balancing means comprising appropriately sized, imbalance-correcting, eccentric weights non-concentrically mounted for rotation on substantially diametrically opposite sides of the axis of rotation of said crankshaft and coupled thereto for rotation in a direction opposite the direction of rotation of the crankshaft, said eccentric weights being further disposed at preselected distances toward opposite ends of said crankshaft from said center of action.

22. A multi-cylinder hot gas engine according to clam 21, wherein the crankshaft initially has been partially balanced by the provision of eccentrically mounted weights secured to and rotating with the crankshaft in a known manner.

23. A multi-cylinder hot gas engine according to claim 21, wherein the counter-rotating residual imbalance correcting eccentric weights are disposed along the virtual balancing shaft axis at preselected distances away from the center of action of the imbalance force acting on the crankshaft in order to reduce to a minimum any residual turning moment.

24. A multi-cylinder hot gas engine according to claim 22, wherein the imbalance-correcting, eccentric weights are rotated at the same speed of rotation as the crankshaft but in a direction opposite the direction of crankshaft rotation and are disposed along the virtual balancing shaft axis a preselected distance away from the center of action of the imbalance force acting on the crankshaft in order to reduce to a minimum any residual turning moment.

25. A multi-cylinder hot gas engine according to claim 24, wherein the imbalance-correcting, eccentric weights are coupled to the crankshaft by separate sets of driving and driven gear wheels with the imbalance-correcting, eccentric weights being carried by to the driven gear wheels.

26. A multi-cylinder hot gas engine according to claim 25, wherein the driven rotating gear wheels carrying the imbalance-correcting, eccentric weights also serve to drive auxiliary equipment required in the running of the reciprocating piston and crankshaft machine on which the virtual balancing axis arrangement is formed.

27. The multi-cylinder hot gas engine recited in claim 23, wherein the imbalance-correcting eccentric weights are carried by the working members of auxiliary devices already required for the engine.

28. The multi-cylinder hot gas engine recited in claim 23, wherein the imbalance-correcting eccentric weights are provided by the working members of auxiliary devices already required for the engine.

29. A multi-cylinder hot gas engine according to claim 20, further including a virtual balancing axis means formed to intersect the crankshaft at or near the center of any force imbalance acting on the crankshaft and being proportioned to eliminate any such force imbalance while simultaneously minimizing any residual turning moment, said virtual balancing axis means comprising appropriately-sized, imbalance-correcting, eccentric weights, non-concentrically mounted for rotating on substantially diametrically opposite sides of the axis of rotation of the crankshaft and coupled thereto for rotation at the same speed but in a direction opposite that of said crankshaft, thereby creating a virtual balancing axis which passes through the center of rotation of the eccentric weights and through the center of action of the force imbalance acting on the crankshaft or as near thereto as possible.

30. A multi-cylinder hot gas engine according to claim 29, wherein the crankshaft initially has been partially balanced by the provision of eccentrically mounted weights secured to and rotating with the crankshaft in a known manner.

31. A multi-cylinder hot gas engine according to claim 30, wherein the imbalance-correcting, eccentric weights are rotated at the same speed of rotation as the crankshaft but in a direction opposite thereto and are disposed along the virtual balancing axis a preselected distance away from the center of action of the imbalance force acting on the crankshaft in order to reduce to a minimum any residual turning moment.

32. A multi-cylinder hot gas engine according to claim 31, wherein the imbalance-correcting, eccentric weights are coupled to the crankshaft by separate sets of driving and driven gear wheels with the imbalance-correcting, eccentric weights being carried by the driven gear wheels.

33. A multi-cylinder hot gas engine according to claim 32, wherein the driven gear wheels carrying the imbalance-correcting, eccentric weights also serve to drive auxiliary equipment required in the running of the piston and crankshaft machine on which the virtual balancing axis means is formed.

* * * * *